US005318714A

United States Patent [19]

Markussen et al.

[11] Patent Number: 5,318,714

[45] Date of Patent: Jun. 7, 1994

[54] STABILIZED PARTICULATE COMPOSITION

[75] Inventors: Erik K. Markussen, Vaerloese; Per Falholt, Gentofte, both of Denmark; Howard Goodman, St. Austell, Great Britain

[73] Assignee: Novo Nordisk A/S, Bagsvaerd, Denmark

[21] Appl. No.: 962,619

[22] Filed: Oct. 16, 1992

Related U.S. Application Data

[63] Continuation of Ser. No. 571,632, Sep. 10, 1990, abandoned.

[30] Foreign Application Priority Data

Mar. 14, 1988 [DK] Denmark ..... 1377/88
Mar. 14, 1988 [DK] Denmark ..... 1378/88

[51] Int. Cl.[5] ..... C11D 3/586; C11D 3/395

[52] U.S. Cl. ..... 252/95; 352/99; 352/174.12; 352/174.13; 352/DIG. 12; 435/188; 435/184

[58] Field of Search ..... 252/174.12, 174.13, 252/DIG. 12, 95, 99; 435/188, 184

[56] References Cited

U.S. PATENT DOCUMENTS

| | | | |
|---|---|---|---|
| 2,955,956 | 10/1960 | Baugh et al. . | |
| 3,650,967 | 3/1972 | Johnson | 252/135 |
| 3,723,250 | 3/1973 | Aunstrup et al. | 195/62 |
| 3,852,211 | 12/1974 | Ohren | 252/110 |
| 3,953,292 | 4/1976 | Burns | 195/63 |
| 4,106,991 | 8/1978 | Markussen et al. | 195/63 |
| 4,597,886 | 7/1986 | Goedhart et al. | 252/95 |
| 4,661,452 | 4/1987 | Markussen et al. | 435/187 |
| 4,689,297 | 8/1987 | Good et al. | 435/174 |
| 4,707,287 | 11/1987 | Herdeman | 252/91 |
| 4,999,125 | 3/1991 | Goodman | 252/90 |

FOREIGN PATENT DOCUMENTS

| | | |
|---|---|---|
| 0181651 | 5/1986 | European Pat. Off. . |
| 0491219 | 1/1930 | Fed. Rep. of Germany . |
| 61-069897 | 4/1986 | Japan . |
| 8707292 | 12/1987 | World Int. Prop. O. . |

OTHER PUBLICATIONS

PCT Search Report for PCT/DK89/00056, Jun. 1989.

*Primary Examiner*—Paul Lieberman
*Assistant Examiner*—Kery A. Fries
*Attorney, Agent, or Firm*—Steve T. Zelson; Elias J. Lambiris

[57] ABSTRACT

Particles containing enzyme or optical brightener in a mixture with particles containing peroxy bleach, surfactant or builder stabilized during storage by coating the former and/or the latter particles with clay, e.g. bentonite.

15 Claims, No Drawings

STABILIZED PARTICULATE COMPOSITION

This application is a continuation application of copending application Ser. No. 07/571,632, filed Sep. 10, 1990, now abandoned.

TECHNICAL FIELD

The invention relates to a particulate composition comprising:

(1) particles containing an enzyme, mixed with (2) separate particles containing a bleaching agent of the peroxy type or a detergent builder.

More specifically, the invention relates to such a composition with improved stability during storage of component (1).

The invention also relates to particles of an enzyme or an optical brightener for use in said composition and to a method of producing said composition or particles.

BACKGROUND ART

Particulate detergents containing particles of an enzyme mixed with separate particles of a bleaching agent or a detergent builder are commonly used. It is known that the latter components may negatively affect the storage stability of the enzyme.

As a solution to this stability problem, the prior art suggests coating of the particles of the enzyme. It is known that the coating material needs to be carefully selected since it must on one hand protect the enzyme and on the other hand release the component rapidly when the detergent is dissolved.

As an example, WO 87/07292 (Novo) (which corresponds to U.S. Pat. No. 4,973,417) teaches that the use of an enteric coating on enzyme particles improves the stability in detergent with bleach; the enteric coating material dissolves at the pH of the detergent solution. However, we have found that this does not always give sufficient storage stability.

Thus, we have recognized that a need exists for a composition wherein the enzyme has improved stability during storage.

STATEMENT OF THE INVENTION

We have surprisingly found that an enzyme in a particulate composition can be stabilized in the above-mentioned mixed composition by applying a clay coating to one or both components.

Clay coating has previously been applied to other components, e.g. bleach activator (EP 51,987), but the use of this coating to the components considered here is novel.

Accordingly, the invention provides a particulate composition comprising:

(1) particles containing an enzyme, mixed with (2) separate particles containing a bleaching agent of the peroxy type or a detergent builder, the composition being characterized in that the particles of the first and/or the second component have a coating containing clay.

The invention also provides a particulate product comprising an enzyme for use in the above composition, characterized by having a coating containing clay.

The invention further provides a method for producing said composition or said particulate product, wherein the particles to be coated and an aqueous dispersion of the coating agent are introduced into a fluid bed drying apparatus, whereafter the material leaving the apparatus is collected as the product.

Finally, the invention provides a method for producing said composition or said particulate product, comprising introducing the particles to be coated and the coating agent together with water and a binder into a mixer, followed by drying.

DETAILED EXPLANATION OF THE INVENTION

Typical examples of particulate compositions according to the invention are cleaning compositions, such as detergents and laundry bleaches.

The composition of the invention contains separate particles of component (1) and (2) as defined above. The latter tend to destabilize the former during storage. According to the invention, one or both is/are coated with clay. The particulate composition of the invention may obviously contain more than one type of particles of component (1) and/or component (2), in which case one or more may be coated according to the invention.

Component (1)

Component (1) is an enzyme, which is commonly used in detergents.

Detergent enzymes are generally microbial, e.g. proteases, amylases, cellulases and lipases. Typical examples of detergent enzymes are: proteases derived from Bacillus (e.g. from *B. licheniformis*, from alkalophilic strains according to U.S. Pat. No. 3,723,250 or subtilisin Novo) or Fusarium (e.g. *F. oxysporum*); amylase derived from Bacillus, especially *B. amyloliquefaciens* (*B. subtilis*) or *B. licheniformis*; cellulase derived from Humicola, especially *H. insolens*; lipase derived from Pseudomonas (e.g. *Ps. cepacia* or *Ps. stutzeri*), Humicola (e.g. *H. insolens*) or Fusarium (e.g. *F. oxysporum*). Examples of commercial detergent enzymes are: Alcalase, Savinase, Esperase, BAN, Termamyl, Celluzyme and Lipolase (all trade names of Novo Industri A/S).

Compositions of the invention typically contain 0.005-5%, e.g. 0.01-2% and especially 0.1-1.5% by weight of particles containing component (1).

Component (2)

Component (2) is a bleaching agent of the peroxy type, or a detergent builder.

Typical bleaching agents of the peroxy type are organic and inorganic peracids and salts thereof, e.g. sodium perborate, sodium percarbonate, potassium persulphate, magnesium peroxy phthalate and diperoxy dodecane dioic acid.

Typical detergent builders are sodium or potassium salts of tripolyphosphoric acid, citric acid, zeolite, ethylenediamine tetraacetic acid (EDTA), diethylene triamine pentaacetic acid (DTPA), and nitrilo triacetic acid (NTA).

The particles containing component (2) will typically be present in amounts above 0.5%, e.g. above 1% and especially above 2% by weight. The amount of component (2) may be more than 50%, and even more than 80%, e.g. in laundry bleaches.

Coating material

The clay used in the coating is preferably a layered clay of the smectite type, such as montmorillonite or bentonite.

Examples of commercially available bentonite products are ASB, e.g. ASB 350 Powder and ASB 350S Powder (ECC International Ltd., St. Austell, Cornwall, England).

The coating material used in the invention may consist essentially of clay, or it may comprise binders, colouring agents (such as $TiO_2$), etc. Conventional binders may be used, e.g. polyvinyl pyrrolidone, polyvinyl alcohol, cellulose derivatives (such as hydroxypropyl-, carboxymethyl- or methyl-cellulose) or carbohydrates (such as dextrin, starch hydrolysates, mono- and di-saccharides and sugar alcohols). If a binder is used, the amount will typically be in the range 1-30% of the coating material desirably the coating material contains above 70% and preferably above 90% of clay.

To obtain the stabilization that forms the object of the invention, the amount of coating material should generally be above 0.1%, preferably above 0.5% and most preferably above 2% by weight of the coated particles.

The clay types used in the invention may be useful detergent ingredients in their own right, acting as antiredeposition agents. To obtain this effect, it is generally preferred that the amount of clay makes up 0.1-20% of the total weight of the composition of the invention.

For increased protection against a bleaching agent, the clay coating applied to the enzyme according to the invention may additionally comprise an antioxidant. The antioxidant may be a thiosulphate, a sulphite, a bisulphite, ascorbic acid or an ascorbate, the salts being preferably sodium or ammonium salts.

For increased stabilization, the enzyme may have an additional protective coating, e.g. consisting of or containing a low-melting wax (such as polyethyleneglycol), enteric coating according to WO 87/07292, a mono-or diglyceride or a sorbitan ester. This additional coating and the clay coating may both be applied to the same particles of enzyme, with either coating as the top coating. Alternatively, the additional coating may be applied to the enzyme and the clay coating to component (2).

Particle form

The particles to be coated according to the invention are preferably granulated. Granulation may be done according to methods known in the art, e.g. NL-C 167,993 (Novo), U.S. Pat. No. 4,106,991 (Novo) or U.S. Pat. No. 4,661,452 (Novo).

The particle size is preferably such that at least 90% lie in the range 3-2000 μm. For a granulate, at least 90% will usually lie in the range 250-2000 μm (standard granulate) or in the range 100-400 μm (microgranulate).

Coating method

The coating according to the invention can be applied by means of any fluid bed method, e.g. a usual fluid bed process, a Wurster bed process or a rotor bed (Glatt) process (vide e.g. David M. Jones, "Factors to consider in fluid-bed processing", Pharmaceutical Technology, April 1985). The fluid bed method can be carried out batch wise or continuously.

Alternatively, the coating can be applied by introducing the particles and the coating agent together with water and a binder into a mixer, followed by drying (e.g. fluid-bed drying). The mixer may be a Lodige mixer or any type of granulator described in US 4,106,991 at col. 4. Conveniently, the coating agent is introduced as a dry powder, and the binder as an aqueous solution or dispersion. The amount of water should be adjusted so as to avoid agglomeration on one hand, and avoid excessive dust on the other hand. The particles may be introduced first, and the coating agent and binder later, either continuously or intermittently.

EXAMPLES

Example 1

A base (uncoated) granulate of alkaline protease was prepared with the following composition:

22% protease concentrate (SAVINASE (reg. TM of Novo Industri A/S), prepared according to US 3,723,250 at col. 12, activity 40 KNPU/g)
15% fibrous cellulose (ARBOCEL BC 200)
4% titanium dioxide
10% carbohydrate binder
49% finely ground sodium sulphate The granulate was prepared as described in Example 1 of U.S. Pat. No. 4,106,991, using pure water as granulating agent. After drying, the granulate was sieved, and the fraction between 300 and 900 μm was collected.

Part of the above base granulate was coated with bentonite which was sealed to the granulate surface with carbohydrate binder, as follows: 15 kg of the base granulate was introduced into a Lödige mixer FM 50. 5 kg of bentonite ASB 350 ECC was dosed continuously by the use of a self-regulating loss-in-weight feeding system into the mixer which ran at 95 rpm during the whole layering process. The feeding rate of the bentonite was 50 kg/h. Simultaneously, 0.45 kg of carbohydrate binder as a 25% solution was sprayed to bind the bentonite to the granulate surface using a peristaltic pump and an air atomizing nozzle (atomizing pressure 2 $kg/cm^2/g$, pumping rate 300 g/min). After layering of the bentonite, the wet coated granulate was treated for 1 min. with the granulating device as described in U.S. Pat. No. 4,106,991. The velocity of the mixing device was during this period raised to 180 rpm. The granulate was finally dried to a water content below 1% and sieved to between 300 μm and 1000 μm.

Another sample of base granulate was coated as above except that the bentonite was type 350S, ECC. Part of this granulate was further coated by applying a solution containing 7% of polyethylene glycol and 12.5% of a 1:1 mixture of titanium dioxide and kaolin (SPESWHITE ECC) as described in example 22 of U.S. Pat. No. 4,106,991.

For comparison, part of the base granulate was coated with PEG as described above, to represent a prior-art coated granulate.

Storage stability tests were carried out by adding granulate to a powder detergent with 25% perborate, storing this at 37° C. and 70% relative humidity, and determining the residual protease activity. Results are expressed in percentage of initial activity. The storage tests were run in 2 series.

| Granulate coating | % residual activity after | | |
|---|---|---|---|
| | 3 days | 7 days | 14 days |
| Series A | | | |
| Bentonite ASB 350 | 71 | 49 | 37 |
| Bentonite ASB 350S | 62 | 39 | 27 |
| Bentonite ASB 350S + PEG | 75 | 41 | 31 |
| Prior art (PEG) | 50 | 26 | 19 |
| Series B | | | |
| Bentonite ASB 350 | 66 | 47 | 38 |
| Prior art (PEG) | 59 | 41 | 19 |

-continued

| Granulate coating | % residual activity after 3 days | 7 days | 14 days |
|---|---|---|---|
| None | 59 | 36 | 25 |

The results show a marked improvement of storage stability in samples coated according to the invention. The prior-art coating shows no improvement over the uncoated granulate.

EXAMPLE 2

A base granulate of alkaline protease was prepared and sieved as in Example 1, except that the following composition was used:

7% protease concentrate (ESPERASE (reg. TM of Novo Industri A/S), prepared according to US 3,723,250 at col. 12, activity 82 KNPU/g)
10% fibrous cellulose (ARBOCEL BC 200)
4% kaolin SPESWHITE ECC
10% carbohydrate binder
69% finely ground sodium sulphate 15 kg of the base granulate was coated with 5 kg of bentonite ASB 350 and sealed with 0.45 kg of carbohydrate binder in the following manner. The base granulate was introduced into a Lödige mixer FM 50. The coating/layering was applied with continuous mixing and alternately applying bentonite and binder solution (25% carbohydrate in water) in such a balanced way that the charge was neither too sticky nor contained a substantial amount of free bentonite powder. The actual sequences and amounts of material were:

1. 200 g binder solution
2. 1670 g bentonite
3. 500 g binder solution
4. 1670 g bentonite
5. 500 g binder solution
6. 1670 g bentonite
7. 500 g binder solution
8. 2 min. treatment with granulating device, mixer 180 rpm
9. 150 g binder solution
10. 1 min. treatment with granulating device, mixer 180 rpm The granulate was finally dried to a water content below 1% and sieved to between 300 μm and 1000 μm.

Part of the above bentonite-coated granulate was further coated with a water-insoluble sorbitan ester of a fatty acid (FAMODAN TS, Grindsted Products) as described in Example 1 for PEG.

For comparison, part of the base granulate was coated with PEG as in Example 1. Storage stability tests were carried out as in Example 1. Results:

| Granulate coating | % residual activity after 3 days | 7 days | 14 days |
|---|---|---|---|
| None | 32 | 25 | 19 |
| Bentonite | 52 | 32 | 25 |
| Bentonite + sorbitan ester | 86 | 56 | 36 |
| Prior art (PEG) | 30 | 22 | 13 |

The results show that storage stability is significantly improved by use of a bentonite coating according to the invention, and is further improved by combining this with a wax coating. The prior-art coating gives no improved stability.

EXAMPLE 3

A base granulate of alkaline protease prepared as in Example 1 was coated with a layer of bentonite ASB 350 and sodium thiosulphate by a conventional fluid-bed process. 350 g of bentonite and 350 g of sodium thiosulphate were dispersed/dissolved in water and sprayed onto 7 kg of base granulate in a Glatt WSG 5 fluid-bed with continuous layering and drying (Air inlet temperature 50° C., air outlet temperature 35° C.). The process was completed by a 5 min. drying period with air inlet temperature 50° C. The granulate was hereafter coated with 5% glyceryl stearate/palmitate (Grindtek MSP 90, Grindsted Products) and 12.5% $TiO_2$:kaolin as described in Example 1 for PEG.

Storage tests were made as in Example 1. A prior-art coating (PEG) was included for comparison.

| Granulate coating | % residual activity after 3 days | 7 days | 14 days |
|---|---|---|---|
| Bentonite/thiosulphate + monoglyceride | 100 | 87 | 53 |
| Prior art (PEG) | 53 | 23 | 15 |

Comparison of the above results with Example 1 shows that incorporation of thiosulphate and monoglyceride gives a further improvement of the storage stability obtained with bentonite coating.

Example 4

Lipase was produced according to EP 305,216 and concentrated by ultrafiltration and evaporation. The resulting liquid lipase concentrate had an activity of 520,000 LU/g (see EP 305,216). The following powder components:

6.0 kg fibrous cellulose ARBOCEL BC200
4.0 kg kaolin SPESWHITE/ECC
4.2 kg carbohydrate binder
24.4 kg finely grounded sodium sulphate were mixed and granulated in a Lödige FM 130 mixer. 11 kg of the above fluid lipase concentrate was used as the granulating liquid by spraying it on the powder components. Otherwise the granulation process was performed as described in example 1 of U.S. Pat. No. 4,106,991.

15 kg of the base granulate was coated with 5 kg of bentonite (ABS 350) and sealed with 0,45 kg of carbohydrate binder in a manner as described in example 3. The granulate was finally dried to a water content below 1% and sieved to between 300 μm and 1000 μm.

Storage stability tests were carried out with storage conditions as described in example 1.

The bentonite coated lipase granulate showed 2% loss of activity after 4 days storage and 11% loss after 10 days storage.

For comparison, the base granulate showed 9% loss of activity after 4 days storage and 23% after 10 days storage.

We claim:

1. A particulate laundry bleach or detergent composition, comprising a detergent enzyme and a second component selected from the group consisting of bleaching agents and detergent builders, wherein the enzyme and the second component consist essentially of:

(1) particles consisting essentially of the enzyme and
(2) separate particles consisting essentially of the second component, wherein one or both of the particles comprising the enzyme and the separate particles comprising the second component are separately coated with a coating material comprising a layered clay.

2. The composition of claim 1, wherein the enzyme is a microbial enzyme selected from the group consisting of protease, amylase, cellulase and lipase.

3. The composition of claim 1, wherein the second component is a bleaching agent selected from the group consisting of organic and inorganic peracids and salts thereof.

4. The composition of claim 3, wherein the second component is selected from the group consisting of sodium perborate, sodium percarbonate, sodium persulfate, magnesium peroxy-phthalate and diperoxydodecanedioic acid.

5. The composition of claim 1, wherein the second component is a detergent builder selected from the group consisting of zeolites and alkali metal salts of tripolyphosphoric acid, citric acid, ethylene diamine tetraacetic acid, diethylene triamine pentaacetic acid and nitrilotriacetic acid.

6. The composition of claim 1, wherein the particles comprising the enzyme are present in an amount of 0.005–5% by weight of the composition.

7. The composition of claim 1, wherein the particles comprising the second component are present in an amount above 0.5% by weight of the composition.

8. The composition of claim 1, wherein the clay is present in an amount above 70% by weight of the coating material.

9. The composition of claim 1, wherein the coating material further comprises a binder in an amount of 1–30% by weight of the coating material.

10. The composition of claim 1, wherein the clay is montmorillonite or bentonite.

11. The composition of claim 1, wherein the coating material is present in an amount above 0.1% by weight of the coated particles.

12. The composition of claim 1, wherein the clay is present in an amount of 0.1–2% by weight of the composition.

13. The composition of claim 1, wherein the coated particles are further coated with a coating material selected from the group consisting of wax having a melting point above 35° C., enteric substance, monoglyceride, diglyceride and sorbitan ester.

14. The composition of claim 1, wherein the second component is a bleaching agent, the particles containing the enzyme are coated, and the coating material further comprises a reducing agent selected from the group consisting of sulfite and thiosulfate.

15. The composition of claim 1, wherein the coated particles have a size distribution such that more than 90% by weight of the coated particles have a size in the range from 3 to 2,000 μm.

* * * * *